US005341200A

United States Patent [19]

Thomas

[11] Patent Number: 5,341,200

[45] Date of Patent: Aug. 23, 1994

[54] REMOVABLE PROCESS UNIT WITH WASTE TONER STORAGE

[75] Inventor: Karlene R. Thomas, Rochester, N.Y.

[73] Assignee: Xerox Corporation, Stamford, Conn.

[21] Appl. No.: 997,047

[22] Filed: Dec. 28, 1992

[51] Int. Cl.[5] ..... G03G 21/00

[52] U.S. Cl. ..... 355/298; 355/200; 355/210; 355/260

[58] Field of Search ..... 355/200, 210, 296, 298, 355/299, 301, 260; 118/652

[56] References Cited

U.S. PATENT DOCUMENTS

| | | | |
|---|---|---|---|
| 3,985,436 | 10/1976 | Tanaka et al. | 355/200 |
| 4,325,628 | 4/1982 | Torigai et al. | 118/652 X |
| 4,556,308 | 12/1985 | Hoppner et al. | 355/200 |
| 4,849,791 | 7/1989 | Hagihara et al. | 355/298 |
| 4,860,056 | 8/1989 | Kano et al. | 355/298 |
| 4,862,226 | 8/1989 | Imaizumi et al. | 355/298 |
| 5,065,195 | 11/1991 | Haneda et al. | 355/298 |
| 5,066,976 | 11/1991 | Kanagawa et al. | 355/200 |
| 5,111,246 | 5/1992 | Brailsford et al. | 355/245 |
| 5,204,720 | 4/1993 | Ishida et al. | 355/260 |
| 5,206,692 | 4/1993 | Ishida et al. | 355/260 |
| 5,285,250 | 2/1994 | Yoshioka | 355/298 |
| 5,289,241 | 2/1994 | Sugiyama et al. | 355/260 |

FOREIGN PATENT DOCUMENTS 0121075 6/1986 Japan .

*Primary Examiner*—Matthew S. Smith

[57] ABSTRACT

A removable process unit for an electrostatographic printing machine has a photoreceptor, a frame having a longitudinal axis to movably mount the photoreceptor therein parallel to the longitudinal axis, a cleaning sump extending parallel to the longitudinal axis and adjacent the photoreceptor, a toner transport to transport toner cleaned from the photoreceptor toward one end of the sump, the toner sump having an aperture at one end, a cover for the frame at the one end thereof, the cover including a cavity with an aperture in communication with the aperture in the sump for storage of cleaned toner.

15 Claims, 5 Drawing Sheets

REMOVABLE PROCESS UNIT WITH WASTE TONER STORAGE

BACKGROUND OF THE INVENTION

The present invention is directed to a removable process unit for use in electrostatographic printing apparatus and in particular to a cover for such a removable process unit having a cavity for the storage of toner cleaned from a photoreceptor.

Recently there has been a tendency in the design of electrostatographic printing apparatus to place one or more of the functional units such as a photoconductor drum or developer housing in a removable processing cartridge or unit so that the customer or operator of the printing machine may replace a functional unit when it's lifetime has been exhausted or a different processing parameter such as toner color is desired. Exemplary of such machines are those described and illustrated, for example, in U.S. Pat. Nos. 3,985,436 to Tanaka et al., 4,556,308 to Hoppner et al. and 5,111,246 to Brailsford et al., all of which are hereby incorporated in their entirety herein by reference. Accordingly, the removable processing cartridges may be designed to contain a photoreceptor, a developing device, a cleaning device as well as a charging device. Alternatively, instead of placing all of the functional elements in a single processing cartridge there may be two or more processing cartridges wherein, for example, the photoreceptor, cleaning device and charge device are in one removable processing cartridge while the developer device is in another removable processing cartridge.

There is a desire, particularly with the smaller electrostatographic printing machines, to make these removable process units or cartridges as small as possible. Accordingly, the capacity of a cleaner sump, for example, in such a removable process unit may be diminished to accommodate this desire for compactness. As a result the capacity to store cleaned toner in such a removable process unit is somewhat limited and is particularly limited where the process unit is being used in an extended life environment wherein it is used until something in it fails rather than being used for only a stated number of prints. As illustrated in FIG. 1, one way of providing additional capacity for the storage of cleaned toner in the past has been to transport cleaned toner from the cleaner sump 10 to the interior of the photoreceptor drum 12. Typically, the transport has been accomplished with the use of a flexible auger 13 within a flexible tube 14 which turns 180 degrees in transporting the toner from the cleaner sump to the interior of the photoreceptor drum. This type of device is difficult to assemble due to the number of parts, their flexible nature and the required side assembly motions. Moreover, it is difficult in many instances to reuse the drum since it is difficult to remove the toner from the interior of the drum without damaging the sensitive photoreceptor surface. Because of the number of parts including a flexible auger and a flexible tube as well as mounting seals and the side assembly the process unit is relatively expensive. In addition, when the drum becomes full of toner the auger continues to rotate and backs out of the drum forcing itself into a twisted knot which may damage the auger and drive mechanism.

SUMMARY OF THE INVENTION

The present invention is directed to a removable process unit for an electrostatographic printing machine wherein there is additional capacity to store waste toner cleaned from the photoreceptor surface. In particular, the process unit cover on one end of the process unit has a waste toner storage cavity for the storage of toner therein.

In a specific aspect of the present invention a removable process unit for an electrostatographic printing machine comprises a photoreceptor, a frame having a longitudinal axis including means to movably mount the photoreceptor therein along said axis, a cleaning sump extending along the longitudinal axis and adjacent the photoreceptor, means to transport toner cleaned from the photoreceptor toward one end of the sump, the sump having an aperture at that end and a cover for the frame at that end of the sump including a cavity with an aperture in communication with the aperture in the sump for the transport of cleaned toner into said cavity for storage.

In a further aspect of the present invention the cover has at least one hand indent to facilitate insertion and withdrawal of the removable process unit from a printing machine.

In a further aspect of the present invention the hand indent comprises a ribbed thumb indent on the top portion of the cover and a finger grip indent on the bottom portion of the cover.

In a further aspect of the present invention the photoreceptor is a rotatably mounted cylindrical drum having a photoconductive insulating surface.

In a further aspect of the present invention the toner is transported in said cleaning sump to said one end by a rotatably driven auger which is driven through a slip clutch which drives the auger until the torque reaches a level representing that the cavity is full.

In a further aspect of the present invention an automatic printing machine has a lower base mounting frame and an upper mounting frame for mounting the functional components of the machine. The upper mounting frame is mounted for upward movement about one end thereof to one end of the lower frame in a clam shell-like manner and the removable processing unit is mounted in the upward frame whereby when the upward frame is pivoted upwardly the cavity is oriented at an angle such that toner automatically falls by gravity away from the aperture in the cavity.

DESCRIPTION OF PREFERRED EMBODIMENT

Figure 1:
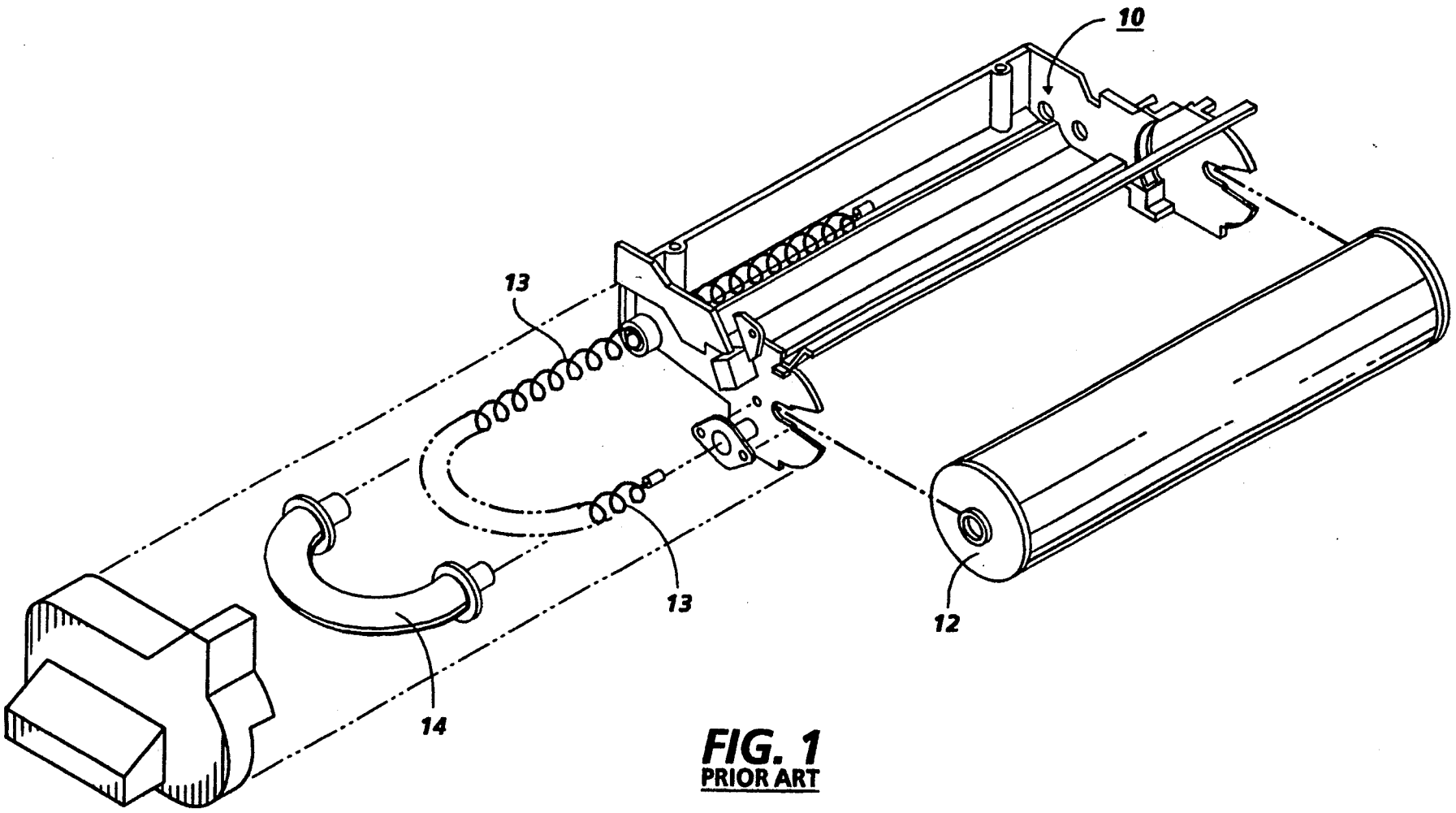
FIG. 1 PRIOR ART
FIG. 1 is an exploded isometric view of a removable process unit according to the prior art.
Figure 2:
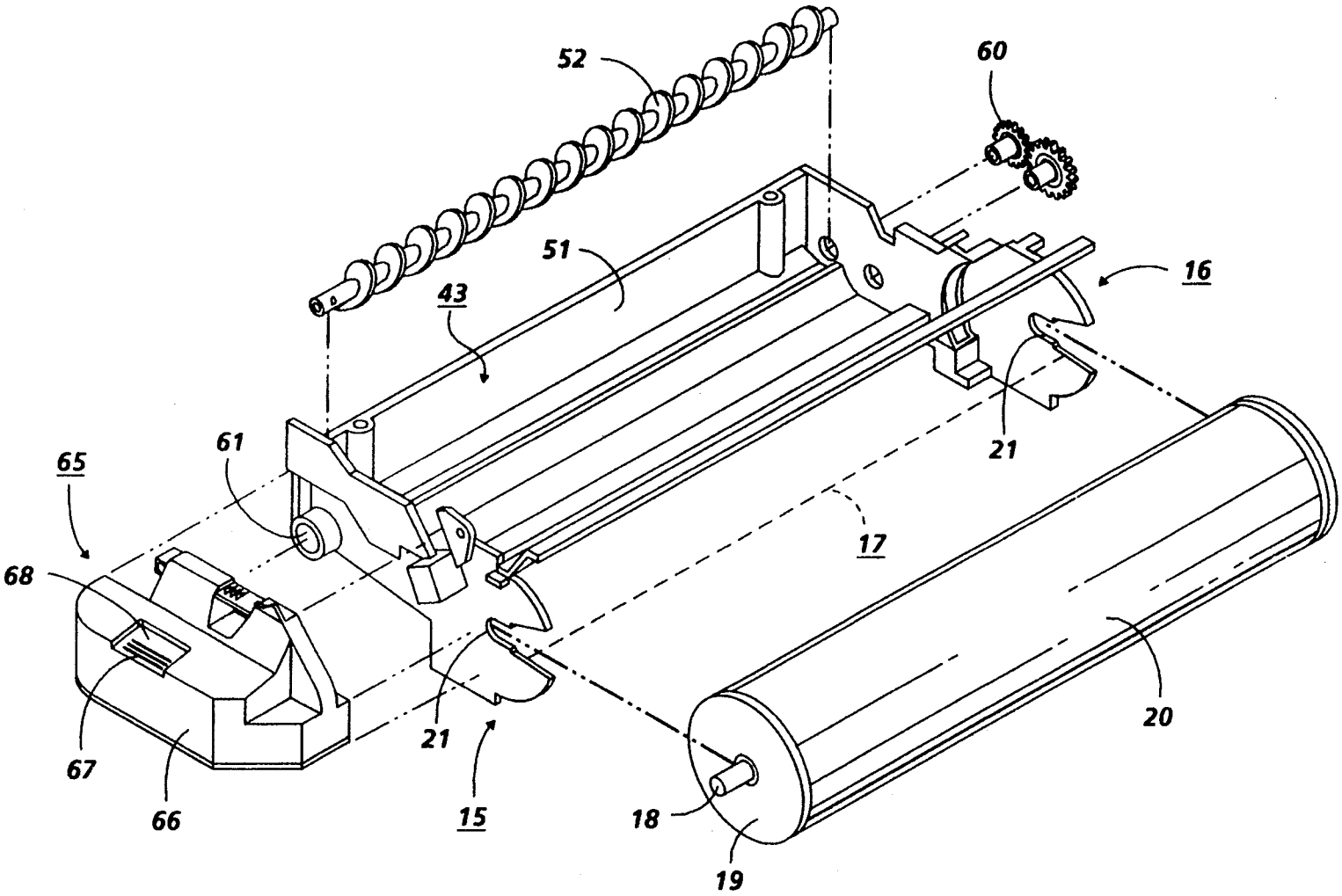
FIG. 2 is an exploded isometric view of the removable process unit according to the present invention.
Figure 3:
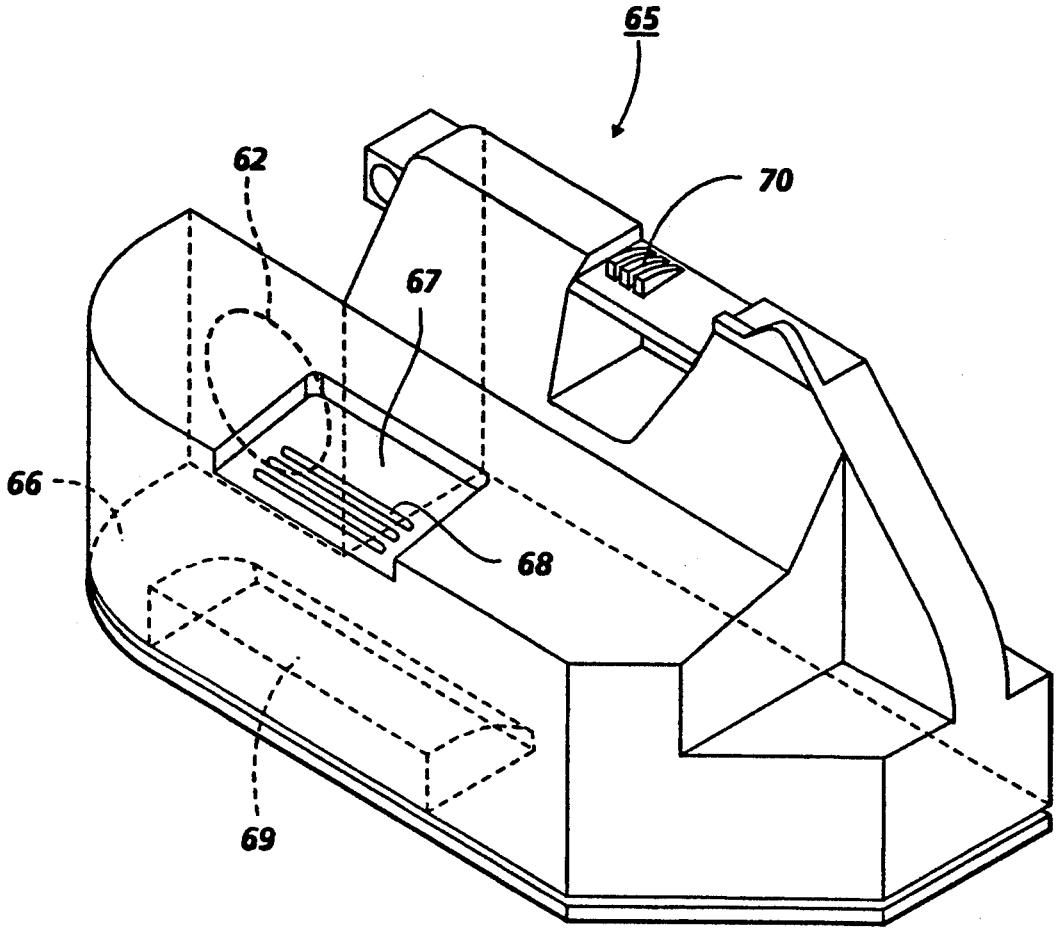
FIG. 3 is an enlarged isometric view of the process unit cover according to the present invention.
Figure 4:
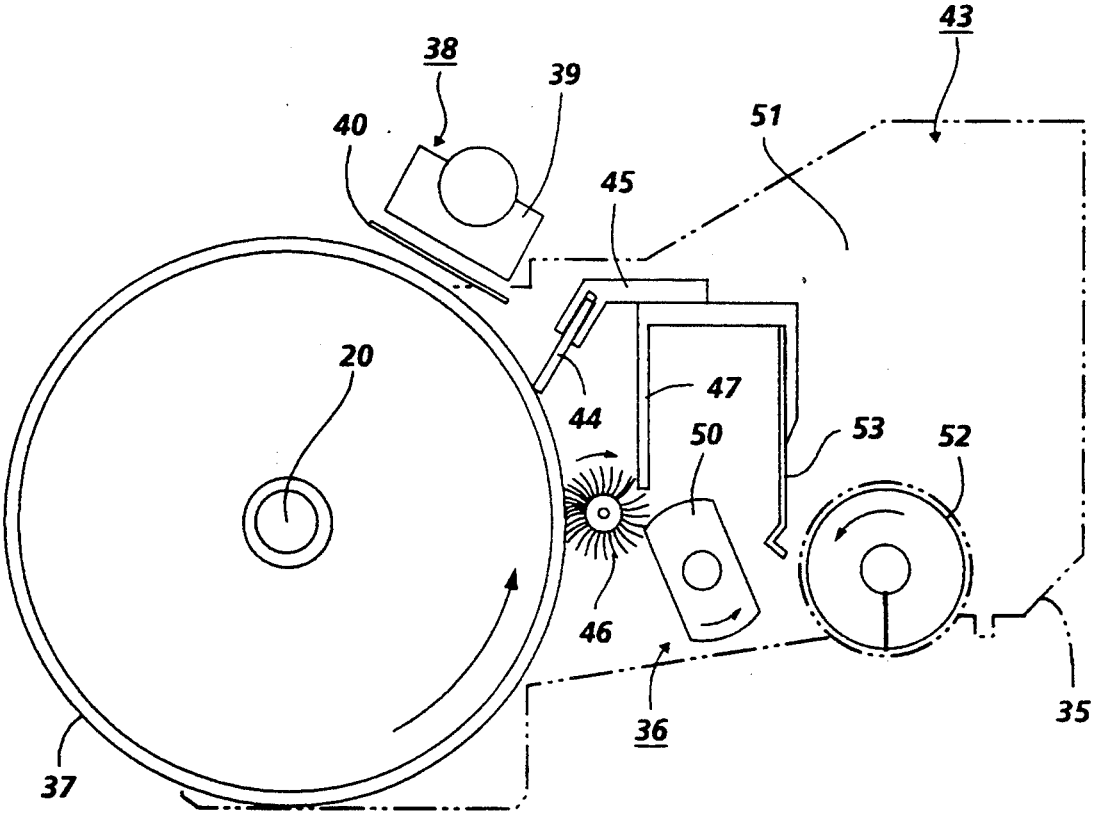
FIG. 4 is a cross sectional view of a removable process unit.

The invention will now be described with reference to the preferred embodiment of the removable process unit. Turning now to FIGS. 2, 3 and 4 the removable processing cartridge or unit 15 has a frame 16 having a longitudinal axis 17 in which a photoreceptor drum 19 having a photoconductive insulating surface 20 is rotatably mounted along a longitudinal axis 17 of the support shaft 18 and slots 21 in the frame 16. The drum is rotatably driven in the indicated direction (See FIG. 4) by means not shown. The charging station 38 includes the charge corotron 39 in a corotron grid 40 (see FIG. 4). The cleaner assembly 43 to the rear of the photoreceptor drum 19 includes a cleaning blade 44 mounted on a supporting bracket 45, a disturber brush 46 to disturb toner on the photoreceptor drum prior to it being cleaned from the surface by the cleaning blade and a flicker bar 47 to flick the toner that may agglomerate on the disturber brush. There is a paddle wheel 50 to transport toner to the rear of the waste toner sump 51 which is parallel to, the longitudinal axis 17 of the frame 16 where an auger 52 which is rotatably driven through a slip clutch 60 (see FIG. 2) drives toner toward one end, the outboard end, of the cleaner sump 51.

At the outboard end of the cleaner sump, there is an aperture 61 which is in toner conveying communication with an aperture 62 in the process unit cover 65 (See FIG. 3) on the outboard end of the process unit. The process unit cover 65 illustrated in FIG. 3 is made of two molded pieces which are ultrasonically welded together, a substantially flat bottom and a shaped top which define a toner storage cavity 66 in between. On the top of the process unit cover 65 is a hand indent 67 having ribs 68 to provide a thumb hold. As seen in FIG. 3 on the bottom of the cover is a finger indent 69 to further facilitate insertion and withdrawal of the unit from the printing machine. The ribs 70 at the top of the cover are a catch for a latch in the main machine for holding the process unit in place. The auger is rotatably driven through a slip clutch 60 on the inboard end of the removable process unit. The auger 52 is driven through the slip clutch 60 until the torque reaches a level representing that the cover is full of toner and while the gear keeps rotating, the auger stops and therefore stops trying to transport further toner to the cavity in the process unit cover. As a result, once the cavity in the process unit cover is filled additional waste toner is collected in the cleaner sump.

Figure 5:
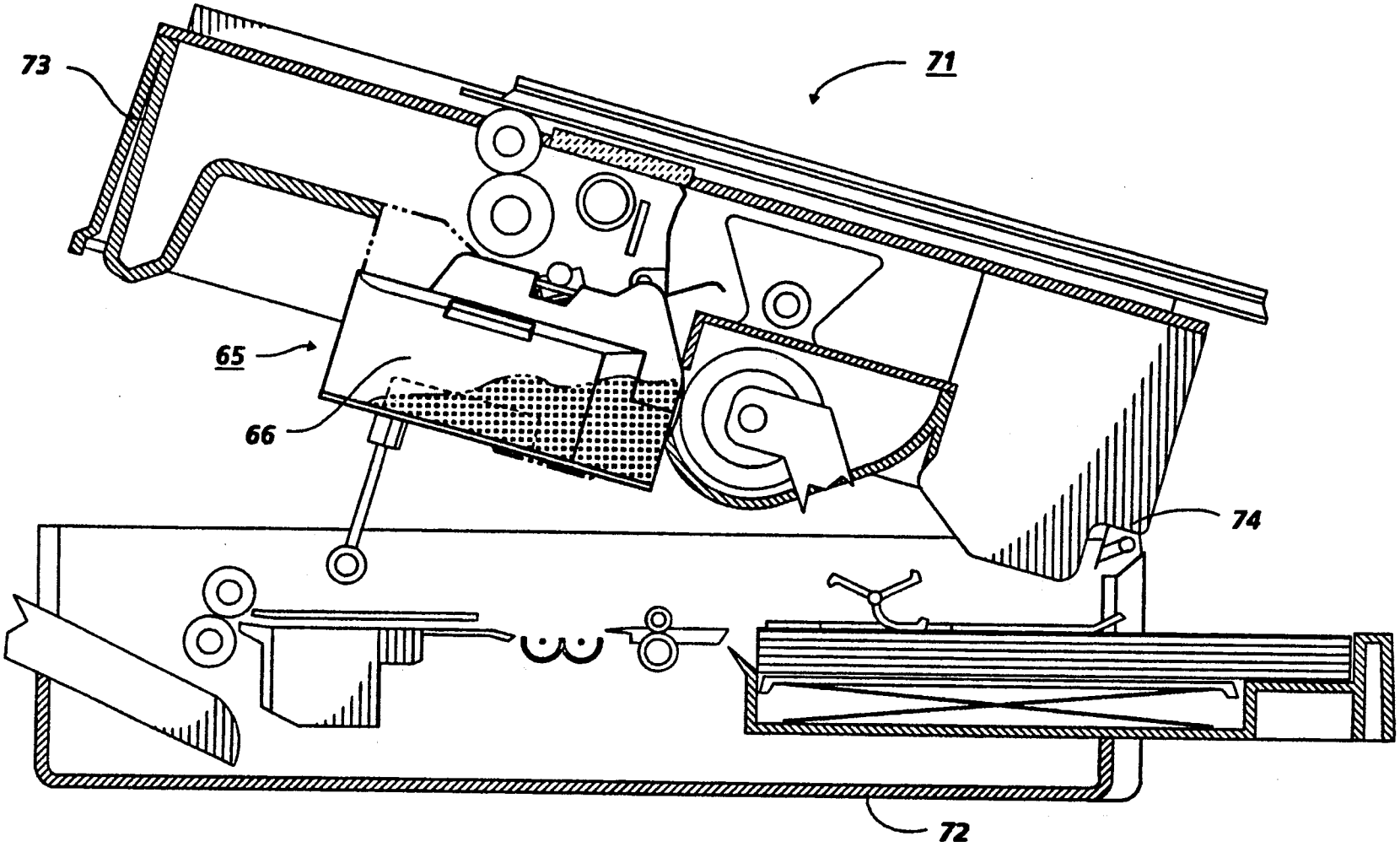
FIG. 5 is a schematic cross sectional view of an automatic electrostatographic printing machine with a removable process unit according to the present invention wherein the upper and lower mounting frames are in the open position.

FIG. 5 is a representation of a typical machine in which the removable process unit may be used. This automatic printing machine 71 comprises a lower base mounting frame 72 and an upper mounting frame 73 pivotally mounted about one end 74 in a clam shell-like manner. The various functional elements used in making a print, are mounted to either the upper or the lower frame members. Typically, the machine is opened by pivoting the upper mounting frame about the one end to expose certain of the functional elements and in particular the paper path to clear a paper jam. As illustrated in FIG. 5, when the upper mounting frame 73 is pivoted to the open position the cavity in the process unit cover is oriented at an angle such that waste toner in the cavity 66 automatically falls by gravity to the remote end of the cavity from the toner entry aperture 62, thereby ensuring a more completely filled cavity in the process unit cover and a more even distribution of toner in the cavity.

Thus, according to the present invention a new removable process unit with increased storage capacity for waste toner has been provided. In particular, the present design has the advantage of requiring fewer parts, eliminating flexible parts that require manual and side assembly and facilitates automated top down assembly thereby providing a less expensive simple process unit. In addition, since toner is not stored in the photoreceptor drum there is the opportunity to reuse the photoreceptor in the same or other process unit.

All the patents referred to herein are hereby specifically and totally incorporated herein by reference.

While the invention has been described with reference to specific embodiments it will be apparent to those skilled in the art that many alternatives, modifications and variations may be made. Accordingly, it is intended to embrace all such alternatives and modifications as may fall within the spirit and scope of the appended claims.

I claim:

1. A removable process unit for an electrostatographic printing machine comprising a photoreceptor, a frame having a longitudinal axis including means to movably mount said photoreceptor therein along said longitudinal axis, a cleaning toner sump extending along said longitudinal axis and adjacent said photoreceptor means to transport toner cleaned from said photoreceptor toward one end of said sump, said toner sump having an aperture at said one end, a cover for said frame at said one end thereof, said cover including a cavity with an aperture in communication with said aperture in said sump for the transport of cleaned toner into said cavity for storage.

2. The process unit of claim 1 wherein said cover has at least one hand indent to facilitate insertion and withdrawal of said unit from a printing machine.

3. The process unit of claim 1 wherein said at least one hand indent comprises a ribbed thumb indent on the top portion of said cover and a finger grip indent on the bottom portion of said cover.

4. The process unit of claim 1 wherein said photoreceptor is a rotatably mounted cylindrical drum having a photoconductive insulating imaging surface.

5. The process unit of claim 1 including means to clean toner from said photoreceptor.

6. The process unit of claim 1 wherein said means to transport toner comprises a rotatably driven auger.

7. The process unit of claim 6 wherein said rotatably driven auger is driven through a slip clutch which drives the auger until the torque reaches a level representing that the cavity is full.

8. An automatic printing machine comprising machine elements includes means for forming an electrostatic latent image on a photoreceptor, means to develop said image with toner, means to transfer said toner image to a receiving sheet and fix it thereto and wherein some of said machine elements are assembled in a removable processing unit, said removable processing unit comprising a photoreceptor, a frame having a longitudinal axis including means to movably mount said photoreceptor therein along said longitudinal axis, a cleaning toner sump extending along said longitudinal axis and adjacent said photoreceptor means to transport toner cleaned from said photoreceptor toward one end of said sump, said toner sump having an aperture at said one end, a cover for said frame at said one end thereof, said cover including a cavity with an aperture in communication with said aperture in said sump for the transport of cleaned toner into said cavity for storage.

9. The automatic printing machine of claim 8 wherein said cover has at least one hand indent to facilitate insertion and withdrawal of said unit from a printing machine.

10. The automatic printing machine of claim 8 wherein said at least one hand indent comprises a ribbed thumb indent on the top portion of said cover and a finger grip indent on the bottom portion of said cover.

11. The automatic printing machine of claim 8 wherein said photoreceptor is a rotatably mounted cylindrical drum having a photoconductive insulating imaging surface.

12. The automatic printing machine of claim 8 including means to clean toner from said photoreceptor.

13. The automatic printing machine of claim 8 wherein said means to transport toner comprises a rotatably driven auger.

14. The automatic printing machine of claim 13 wherein said rotatably driven auger is driven through a slip clutch which drives the auger until the torque reaches a level representing that the cavity is full.

15. The automatic printing machine of claim 8 wherein said machine has a lower base mounting frame and an upper mounting frame for mounting the functional components of the machine, said upper frame being pivotally mounted for upward movement about one end thereof to one end of said lower base frame in clam shell-like manner and wherein said removable processing unit is mounted in said upper mounting frame whereby when said upper frame is pivoted upwardly the cavity is oriented at an angle such that toner automatically falls by gravity away from the aperture in said cavity.

* * * * *